US008250965B2

(12) United States Patent
Ponsart

(10) Patent No.: US 8,250,965 B2
(45) Date of Patent: Aug. 28, 2012

(54) JACK SYSTEM WITH AUTOMATIC LOCKING OF THE PISTON IN HIGH POSITION, ESPECIALLY FOR AIRCRAFT

(75) Inventor: Jaouen Ponsart, Blagnac (FR)

(73) Assignee: Airbus Operations SAS, Toulouse (FR)

( * ) Notice: Subject to any disclaimer, the term of this patent is extended or adjusted under 35 U.S.C. 154(b) by 1056 days.

(21) Appl. No.: 12/145,031

(22) Filed: Jun. 24, 2008

(65) Prior Publication Data

US 2009/0014594 A1 Jan. 15, 2009

(30) Foreign Application Priority Data

Jul. 9, 2007 (FR) ..... 07 56355

(51) Int. Cl.
*F15B 15/26* (2006.01)

(52) U.S. Cl. ..... 92/23; 91/42; 91/DIG. 4

(58) Field of Classification Search ..... 92/15, 23, 92/29; 91/42, DIG. 4; 335/306
See application file for complete search history.

(56) References Cited

U.S. PATENT DOCUMENTS 3,662,653 A * 5/1972 Carlson et al. ..... 92/15
4,890,703 A 1/1990 Hathaway
8,100,363 B2 * 1/2012 Ponsart et al. ..... 244/129.4
2004/0168284 A1 9/2004 Duffy
2005/0155179 A1 * 7/2005 Duffy ..... 16/66
2006/0214756 A1 * 9/2006 Elliott et al. ..... 335/306

FOREIGN PATENT DOCUMENTS

DE 198 40 766 A1 3/2000
DE 19840766 A1 * 3/2000
FR 2 887 281 A1 12/2006
GB 2429032 A * 2/2007

* cited by examiner

*Primary Examiner* — Allana Lewin
*Assistant Examiner* — Logan Kraft
(74) *Attorney, Agent, or Firm* — Oblon, Spivak, McClelland, Maier & Neustadt, L.L.P.

(57) ABSTRACT

A jack system provided with a cylinder provided with a first stopper. The jack system also includes: a body hinged about an end of the piston, the body including a second stopper and being able to occupy a first angular position authorizing the extraction of the piston, as well as a second angular position uniquely allowed when the piston occupies a position such that the second stopper is located beyond the first stopper in an extraction position, the body occupying the second position providing the facing of the first and second stoppers; and an electromagnetic attraction/repulsion device designed to provide the displacement of the body from the first position to the second position, and inversely.

20 Claims, 8 Drawing Sheets

JACK SYSTEM WITH AUTOMATIC LOCKING OF THE PISTON IN HIGH POSITION, ESPECIALLY FOR AIRCRAFT

This invention generally relates to the field of jack systems, in particular those used on aircraft, for example to provide the automated closing/opening of a hinged flap. For the purposes on information, an example of a flap is provided in FR 2 887 281.

As such, the invention is particularly but not exclusively adapted for use on large and very large commercial aircraft.

The purpose of the invention is substantially to provide a jack system making it possible to procure safe and reliable blocking of the piston resting in extracted position, also referred to as high position, in order to prevent an involuntary pressure exerted on the jack from accidentally resulting in a retraction of the piston in its associated cylinder.

For this, the object of the invention is a jack system comprising a jack provided with a cylinder wherein slides a piston having an external end, said cylinder being equipped with first stop means. According to the invention, the system further comprises:

a body arranged around said jack and hinged about said external end of the piston, according to a pivot axis, said body comprising second stop means and being able to occupy, relatively in relation to the jack and according to the pivot axis, a first angular position allowing for an extraction/retraction of the piston in relation to the cylinder, as well as a second angular position uniquely allowed when the piston occupies in relation to the cylinder an extracted position such that said second stop means is located beyond said first stop means in an extraction position of the piston in relation to the cylinder, the body occupying said second position providing the facing, according to the extraction position, of the first and second stop means; and an electromagnetic attraction/repulsion device comprising a first element fixedly mounted on said cylinder as well as a second element fixedly mounted on said body, said device being designed to provide the displacement of the body from said first position to said second position, and inversely, by attraction/repulsion of said first and second elements.

As such, it is to be understood that in the second angular position, also referred to as locking position of the piston, the facing of the first and second stop means makes it possible to offer a safe and reliable blocking of the piston in extracted position. Indeed, in the first case where the facing takes the form of a putting into contact of these two stop means, the piston is then maintained in its extracted position even in the event of involuntary pressure exerted on the jack, thanks to the stop provided by the aforementioned putting into contact. In the other case where the stop means is arranged across from but not far away from one another, a case which is moreover preferred in order to facilitate the later return to the first position, any retraction of the piston in the cylinder, likely to be encountered subsequent to an involuntary pressure exerted on the jack, will be limited thanks to the entry into contact of the first and second stop means arranged beforehand across therefrom.

Consequently, the jack system according to the invention allows advantageously to procure a safe and reliable blocking of the piston resting in extracted position/high position, while having a design that is simple and inexpensive.

As indicated hereinabove, the displacements from the first angular position to the second angular position, and inversely, which can begin only when the piston occupies in relation to the cylinder an extracted position such that the second stop means is located beyond the first stop means in the extraction position of the piston, take place astutely using an electromagnetic attraction/repulsion device.

As such, it is indicated that the device can be provided in order that one of the two aforementioned displacements is carried out only by a magnetic attraction force between a permanent magnet and a magnetic body. This implies that the concerned displacement from one to the other of the two angular positions of the body can be obtained automatically under the simple effect of the magnetic attraction observed between the two aforementioned elements, which does not require advantageously any power supply of the device. In this preferred case where one of the two displacements of the body is carried out by the simple effect of the magnetic attraction between the permanent magnet and the magnetic body, and where the other displacement is carried out by implication by electromagnetic repulsion of the permanent magnet and of the magnetic body powered electrically in the appropriate manner making it possible to generate a magnetic field providing the repulsion, it will be preferred for reasons of safety to design the jack system in such a way that the simple magnetic attraction provides the passage from the first angular position referred to as unlocking position, to the second angular position referred to as locking position.

Nevertheless, it is noted that the electromagnetic attraction/repulsion device could as an alternative include two magnetic bodies each likely to be powered electrically in such a way as to allow them to jointly and alternatively provide their attraction and electromagnetic repulsion, without leaving the framework of the invention.

More preferably and as mentioned hereinabove, said first and second elements of said electromagnetic attraction/repulsion device are respectively a permanent magnet and a magnetic body capable of being powered electrically by a power supply belonging to said device, or inversely.

Therefore, it is then preferentially arranged in such a way that the device is designed to automatically ensure the displacement of the body from the said first position to said second position, by magnetic attraction of the first element and of the second element that is not powered electrically by said power supply. Naturally, this magnetic attraction is produced automatically, without operator intervention, as soon as the piston is sufficiently extracted from the cylinder in order to position its magnetic element, referred to as the first element, across from the magnetic element, referred to as the second element, carried by the body of the system. More preferably, the system is designed in such a way that the displacement by magnetic attraction of the body to the second position is produced as soon as the second stop means have extended beyond the first stop means in the extraction position of the piston. In this respect, so that the body is maintained in its second position in a state such that its second stop means are positioned across from the first stop means, but without contact with the latter, it is therefore preferentially arranged that the extraction of the piston is stopped only after the body has reached its second position. This ensures the presence of the space sought between the first and second stop means, when the piston occupies its final desired extracted position.

For information, the magnetic attraction observed does not more preferably result in the forceful placing of the permanent magnet against the magnetic body, but uniquely in a bringing nearer of these two elements due to the rotation of the body in relation to the piston, according to the aforementioned pivot axis. This can for example be obtained thanks to an appropriate stopping of the body against the jack, during its rotation.

Moreover, still in the preferred embodiment of this invention, said device is designed to provide the displacement of the body from said second position to said first position by electromagnetic repulsion of the first element and of the second element, the latter being powered electrically by said power supply in order to generate a magnetic field providing said repulsion.

When an operator decides to retract the piston in the cylinder, he must first unlock the jack that beforehand has undergone an automatic locking by facing of the first and second stop means. This unlocking qualified as electromagnetic is therefore carried out in the manner addressed hereinabove, by passing an electric current through the magnetic body, for example in the form of electric pulses. The magnetic body more preferably made of soft iron will then become magnetised and create a magnetic field, which, together with the magnetic field generated by the magnet itself, will provide the desired repulsion.

In order to best prevent the risks of blocking the jack, it is possible to provide a single manual control making it possible for the operator, after having actuated the latter, to first provoke the displacement of the body from the second position to the first position, and then the retraction of the jack, especially thanks to a sequencer or equivalent programmed in a suitable manner. However, two distinct means of control could be provided in order to provide both of the operations mentioned hereinabove, without leaving the framework of the invention.

In this respect, the jack system comprises furthermore a control module, the latter being notably connected to said power supply of said electromagnetic attraction/repulsion device. More preferably, said control module comprises at least one push-button switch, and more preferably two buttons respectively intended on the one hand to control the extraction of the piston, and on the other hand to control the electromagnetic unlocking of the piston and its retraction in the cylinder.

More preferably, said first and second elements each take the form of an angular portion of a hollow cylinder, that can easily be installed on the cylindrical components of circular section that usually comprise jack systems.

Still in a preferred manner, said second stop means are arranged at the free end of an interior hollow rod integral with said corps. In such a case, it is more preferably arranged so that when said body occupies said first angular position, said hollow rod is substantially parallel to said piston.

In addition, said hollow rod has another end connected preferentially fixedly on a portion of the end of the hinged body on said external end of the piston.

More preferably, said body forms a casing around said jack, this casing being able for example to take the form of a tube bearing interiorly the aforementioned hollow rod.

Preferably, the system comprises a connecting brace of the system, hinged around said external end of the piston, according to said pivot axis, which renders it advantageously very compact.

More preferably, said first and second elements of said electromagnetic attraction/repulsion device are respectively fixed exteriorly on an open end of the cylinder, and interiorly on an open end of the body.

Still preferably, said first and/or second stop means are provided with a lining forming a friction surface. Therefore, if an involuntary pressure exerted on the locked jack accidentally results in a retraction of the piston in its associated cylinder, the first and second stop means rapidly establish a contact that is more easily preserved by the presence of the friction lining, which can for example take the form of a lining of rubber or of similar material.

More preferably, the system comprises furthermore mechanical means of backup control, making it possible to provide the displacement of the body from said second position to said first position, or inversely. These entirely mechanical means of backup effectively allow an operator who is actuating them to fulfill the task(s) that are normally the responsibility of the electromagnetic attraction/repulsion device, when the latter has broken down, in particular an electrical power breakdown. In the preferred embodiment where only the displacement from the second position to the first position is realised using the power supply of the device, it is provided that the mechanical means of backup control making it possible solely to provide the displacement of the body from said second position to said first position, by rotation of this same body around the aforementioned pivot axis.

More preferably, said jack is pneumatic or hydraulic, and the jack system comprises a pressurising system of the fluid located in said cylinder, such as a pump known to those skilled in the art.

Another object of this invention relates to a flap provided with an opening/closing system of the latter, this opening/closing system being realised using a jack system such as described hereinabove. As such, this can entail any type of flap, for example hinged about a structure of the aircraft, and in particular intended to provide the passage of the occupants from one space to another of this aircraft.

In this particular case of the application of the invention to a flap, the possible retraction of the piston in the cylinder, described hereinabove and likely to be encountered subsequent to an involuntary pressure exerted on the deployed jack, can for example result from the walking of an occupant of the aircraft on this same flap maintained in open position by the piston occupying its extracted position.

Finally, the invention also has for object an aircraft comprising at least one jack system such as described hereinabove, and/or at least one flap such as described hereinabove.

Other advantages and characteristics of the invention shall appear in the detailed description hereinabove that is not limited.

This description shall be made with regards to the annexed drawings among which;

Figure 2:
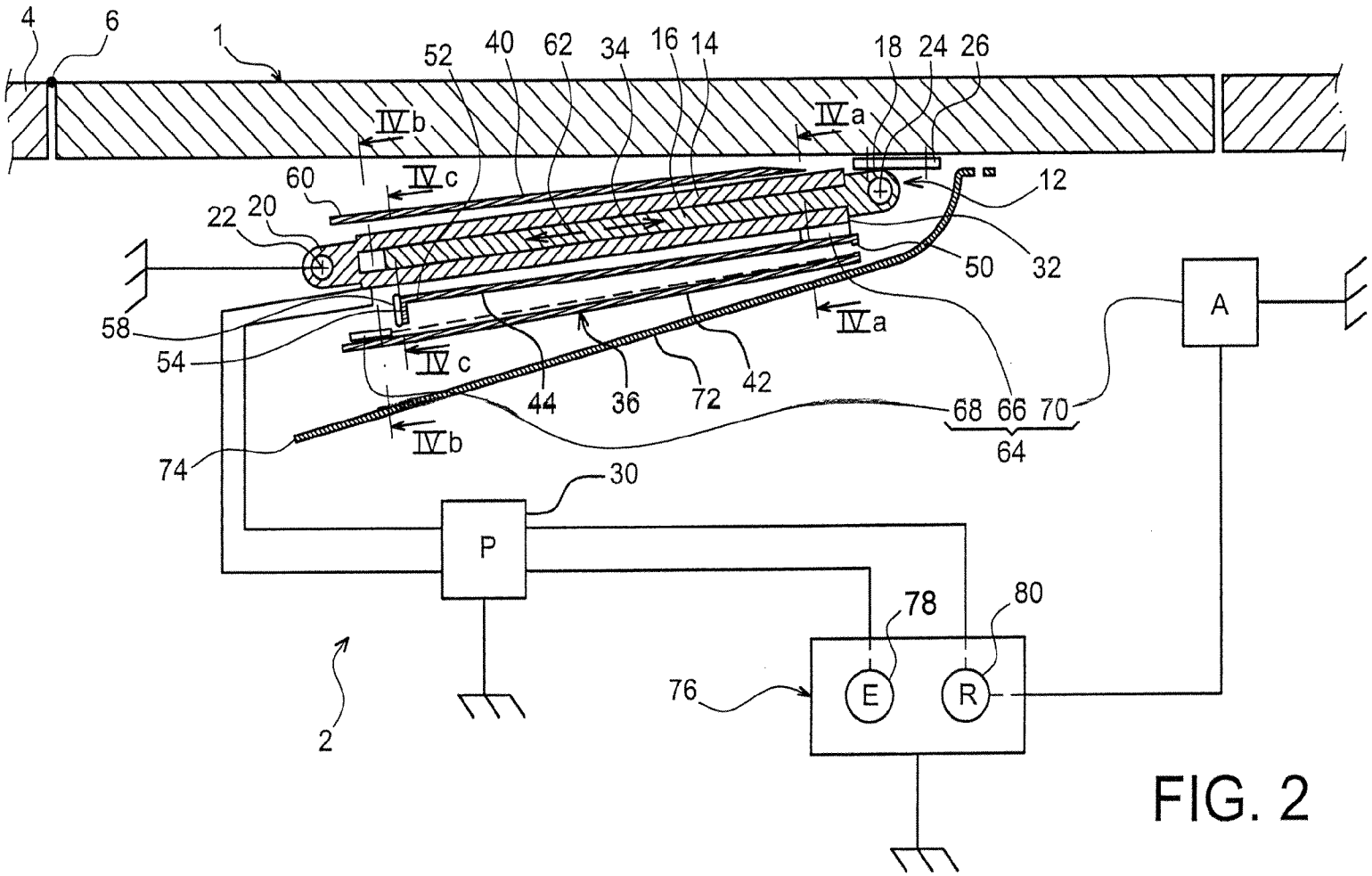
FIG. 2 shows a cross-section taken along the line II-II of FIG. 1.
Figure 4A:
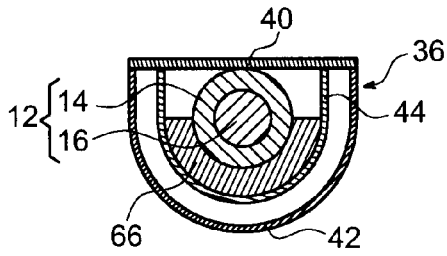
Figure 4B:
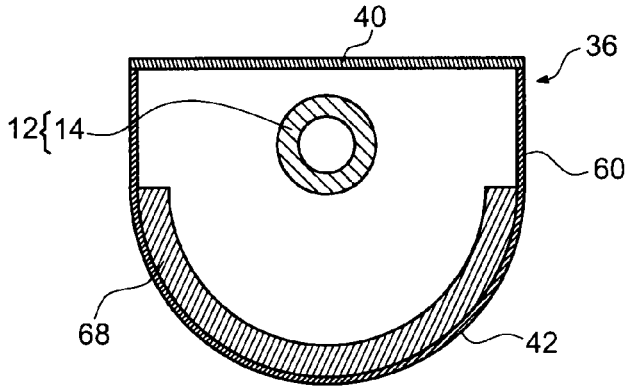
Figure 4C:
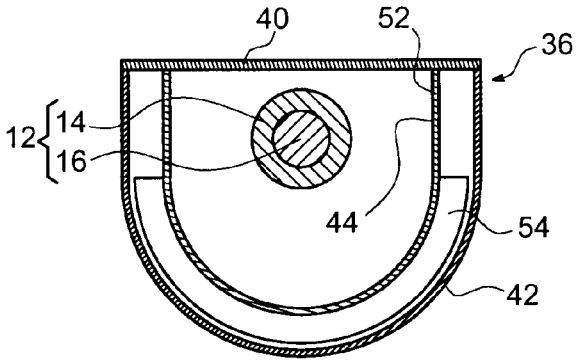

FIGS. 4*a*, 4*b* and 4*c* show cross-section views taken respectively along lines IVa-IVa, IVb-IVb and IVc-IVc of FIG. 2; and FIGS. 5 to 8 show cross-section views schematising the operating principle of the jack system shown in the preceding figures.

Figure 1:
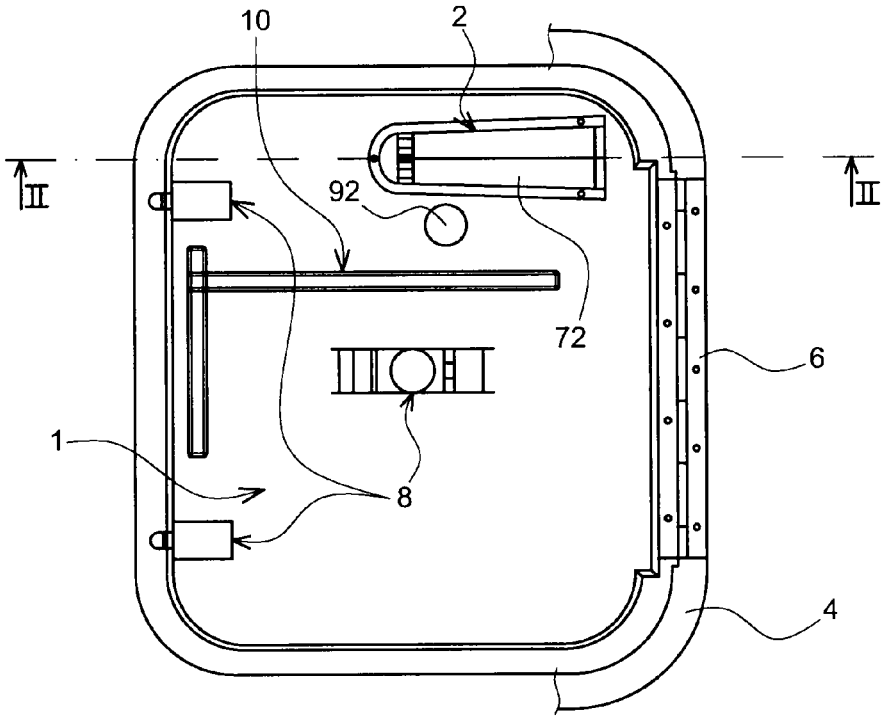
FIG. 1 shows a schematic view of the underneath of a flap provided with an opening/closing system of the latter taking the form of a jack system according to a preferred embodiment of this invention.

In reference first of all to FIG. 1, a flap 1 for aircraft can be seen, provided with an opening/closing system of the latter, this opening/closing system being realised using a jack system 2 according to a preferred embodiment of this invention.

The flap 1, also the purpose of this invention, is hinged about a structure of the aircraft bearing fixedly a flap frame 4 shown only partially and schematically. By way of an informational example, this flap is intended to provide the passage of occupants from one space to another of this aircraft, when it is in open position. More preferably, this entails a flap arranged on a floor of the aircraft, such as the cockpit floor separating an upper cockpit zone for the piloting of the aircraft, and a lower resting zone for the crew also referred to as "FCRC" ("Flight Crew Rest Compartment").

The flap 1 is hinged about the frame 4, by the intermediary of a hinge 6. Furthermore, the flap 1 is provided with means of locking in closed position, referenced 8. These means 8 can take any form known to those skilled in the art, and therefore shall not be described any further. Finally, the internal surface of the flap shown in FIG. 1 can be provided with gripping means 10 such that a bar or a set of bars, facilitating the opening and/or the closing of this flap by an operator located in the lower resting zone for the crew. These means 10 also serve as an access ramp, so that the operator can support himself during his passage.

Nevertheless, as mentioned hereinabove, the flap 1 is provided with a jack system 2 providing in an automatic and controlled manner the opening/closing of this flap, by extraction/retraction of a jack piston causing the pivoting of the flap around the hinge 6. As such, the operator is normally not required to perform the opening/closing of this flap manually, except for example in the event of a breakdown preventing the proper operation of the jack system.

Now in reference to FIGS. 2 to 4*c*, the jack system 2 according to the preferred embodiment of this invention can be seen.

The system 2 comprises first of all a jack 12 provided with a cylinder 14 wherein slides a piston 16 having an external end 18, wherein at the opposite is located a closed end 20 of the cylinder 14. This closed end 20 is mounted in a hinged manner according to an axis 22 on the fixed structure of the aircraft bearing the flap frame 4, while the external end 18 of the piston is mounted in a hinged manner according to an axis 24, parallel to the axis 22, on a connecting brace 26 of the system, this brace being mounted fixedly on the flap 1 as shown in FIG. 2.

For the purposes of information, it is noted that in the rest of the description, the axis 24, which is parallel to the flap 1, shall be referred to as the pivot axis of the jack 12.

The jack 12, of a pneumatic or hydraulic nature, is connected to a pressurising system of a fluid located in the cylinder 14, this pressurising system being able to take the form of a conventional pump known to those skilled in the art, shown schematically by reference 30.

Moreover, the cylinder 14 is provided with a first stop means, which, in the preferred embodiment described, is formed by the open end 32 of the cylinder. More precisely, these stop means 32 have a stop surface which is the end surface of the open end 32, orthogonal to an extraction position of the piston 34 which is parallel to this same piston 16 as well as to cylinder 14. As shall be detailed hereinafter, the first stop means 32 make it possible to provide the locking of the piston 16 in high position.

On the other hand, the jack system 2 comprises a body 36 arranged around jack 12, this corps forming more preferably a casing around the jack as is clearly seen in FIGS. 2 to 4*c*.

Figure 3:
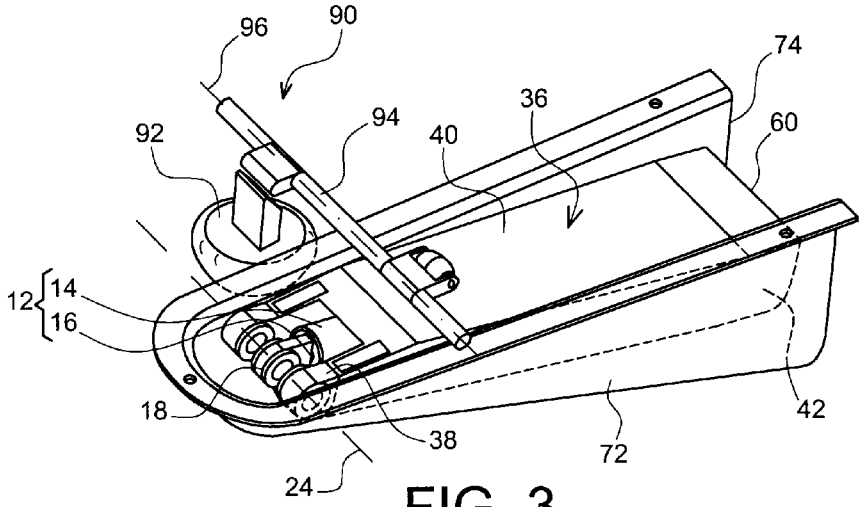
FIG. 3 shows an enlarged perspective view of the jack system shown in FIGS. 1 and 2.

The body 36 has an end portion 38 shown in FIG. 3, of which one of the particularities resides in the fact that it is hinged on the external end 18 of the piston 16, according to the pivot axis 24. Therefore, it is also hinged in relation to the connecting brace 26, still according to the same axis 24.

Starting with this end portion 38, the body 36 extends around the piston 12 by becoming slightly wider, as shown jointly in FIGS. 4*a* to 4*c*.

The exterior portion of the body 36 comprises globally a flat surface 40 wherein at the ends are added fixedly the ends of a cylinder surface 42, for example of semi-circular section.

Inside the exterior portion of the body 36 which has just been defined, is located an interior hollow rod 44 integral with the body. This hollow rod 44 can also have a semi-circular section, thus open longitudinally, with the ends thereof added fixedly on the flat surface 40 as is best seen in FIGS. 4*a* and 4*c*. As such, the hollow rod 44 and the exterior cylinder surface 42 delimit jointly a space forming an annular portion extending from one end of rod 50 connected on the hinged end portion 38 of the body, to a free end 52 of the interior hollow rod.

In this respect, it is noted that the second stop means 54 is arranged on the free end 52 of the interior hollow rod. More precisely, this stop means 54 has a stop surface which is the end surface of the free end 52, orthogonal to the extraction position of the piston 34. For the purposes of information, the second stop means 32 can be provided with a lining 58 forming a friction surface, for example a lining made of rubber or similar material. In such a case, the stop surface is then constituted by the lining itself. As shall be detailed hereinafter, the second stop means 54 makes it possible to provide the locking of the piston 16 in high position, together with the first stop means 32 by facing of these means 32, 54, according to the extraction position 34. Consequently, if an involuntary pressure exerted on the locked jack 12 accidentally results in a retraction of the piston 16 in its cylinder 14, the first and second stop means 32, 54 are then in a position to establish a contact more easily preserved by the presence of the friction lining 58.

As is best seen in FIGS. 2 and 4*c*, the second stop means 54 can take the form of an angular flange ring portion extending towards the exterior cylindrical surface 42, the aforementioned portion extending for example on 180°.

When the piston 16 occupies a retracted position as shown in FIG. 2, the body 36 occupies, relatively in relation to jack 12 and according to the pivot axis 24, a first angular position authorising an extraction/retraction of the piston 16 in relation to cylinder 14. In this first angular position with regards to the jack 12, also referred to as unlocking position, the hollow rod 44 is substantially parallel to the piston 16, and thus to the extraction position 34.

The body 36 has an open end 60 opposite the hinged end portion 38, this end 60 being jointly defined by the end of the flat surface 40 and the end of the cylinder surface 42. As can be seen in FIG. 2, this open end 60 is arranged beyond the second stop means 54, in a retraction direction of the piston referenced 62. This open end 60, which is located in the vicinity of the closed end 20 of the cylinder 14 when the piston 16 is in retracted position, serves substantially as a support for an element of electromagnetic attraction/repulsion device, which shall now be described.

Indeed, the jack system 2 is provided with an electromagnetic attraction/repulsion device 64, comprising a first element 66 of the permanent magnet type fixedly mounted on the cylinder 14, as well as a second element 68 of the magnetic body type fixedly mounted on the body 36, this device 64 being designed to provide the displacement of the body from the first angular position to a second angular position which shall be detailed later, and inversely, by attraction/repulsion of the first and second elements 66, 68.

The first and second elements 66, 68 are more preferably respectively fixed exteriorly on the open end 32 of the cylinder 14, and interiorly on the open end 60 of the body 36. For this, it is provided preferentially that they each take the form of an angular portion of a hollow cylinder, such as can be seen in FIGS. 4*a* and 4*b*.

More precisely, the permanent magnet 66 does not extend beyond the aforementioned stop surface of the first stop means 32, in the extraction position 34. In addition, the exterior surface of this magnet 66 can be complementary to the interior surface of the hollow rod 44, as shown in FIG. 4*a*. As such, during the extraction of the piston 16, the permanent magnet 66 slides along the interior surface of the hollow rod 44 forming a track, with which it remains in contact. Nevertheless, an absence of contact between the two aforementioned entities could be provided, without leaving the framework of the invention.

Furthermore, the magnetic body 68 more preferably made of soft iron and capable to be powered electrically by a power supply 70 belonging to the device 64, does not extend beyond the aforementioned stop surface of the second stop means 54, in the extraction position 34. In other terms, the whole of the magnetic body 68 is located beyond the stop surface of the second stop means 54, in the retraction direction 62.

As can be seen in FIGS. 2 and 3, the jack system 2 can include a protective cover 72 making it possible to confine the body 36 and the jack 12 between this same cover 72 and the flap 1, while still authorising thanks to its opening 74 the extraction of the piston 16.

Moreover, the jack system 2 comprises a control module 76, the latter being in particular connected to the power supply 70 of the electromagnetic attraction/repulsion device 64. More preferably, the control module 76 comprises a push-button switch 78 intended to control the automatic extraction of the piston 16, and a push-button switch 80 intended to control automatically and in a sequenced manner the electromagnetic unlocking of the piston 16 such as shall be described hereinafter, then its retraction in the cylinder 14.

For the purposes of information, the aforementioned control module can be divided, so as to provide a first one accessible to the operator located in the upper cockpit zone, and a second one accessible to the operator located in the lower resting zone.

The operation of the jack system 2 that has just been shown shall now be described.

First of all, when the flap 1 is in closed position such as shown in FIG. 2, the piston 16 occupies a retracted position implying that it is fully introduced into its associated cylinder 14. In this configuration, the body 36 occupies, relatively in relation to jack 12 and according to the pivot axis 24, the first angular position authorising an extraction/retraction of the piston 16 in relation to the cylinder 14. In this respect, it is noted that this first angular position is maintained during the quasi-totality of the extraction of the piston, since the implantation of the jack system 2 is such that during this same extraction of the piston 16, the flat surface 40 of the body 36 remains in contact/stop by gravity against the exterior surface of the cylinder 14.

Figure 5:
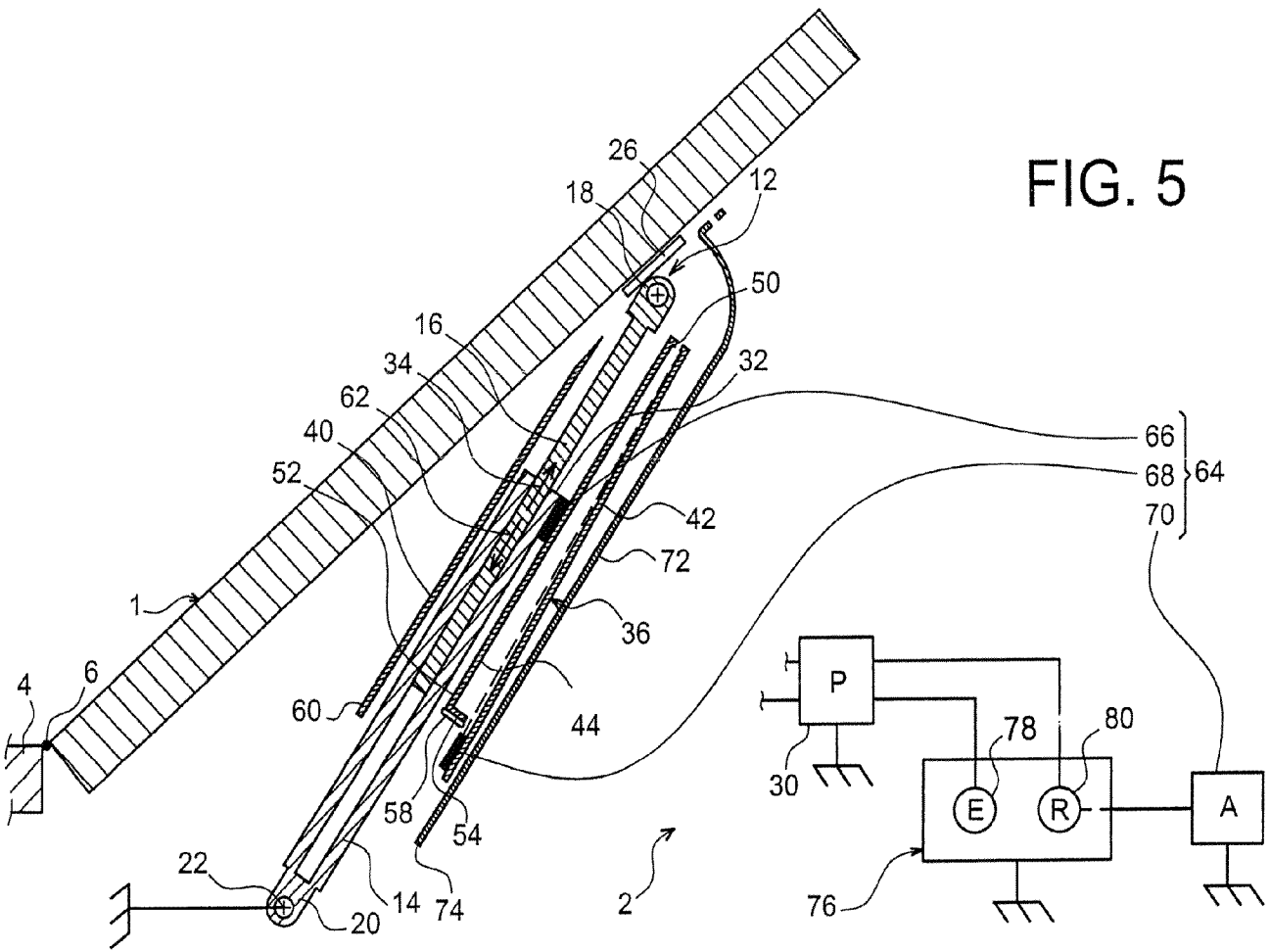

When the operator wishes to open the flap 1, he actuates the push-button switch 78 provided for this purpose on the control module 76, a button which controls the pump 30 in order to pressurise the fluid located inside the cylinder 14. This pressurisation of the incompressible fluid causes the extraction of the piston 16 outside of the cylinder 14, according to the extraction position 34. During this extraction during which the aforementioned first angular position of the body 36 in relation to jack 12 is therefore substantially maintained, the jack pivots around the axis 22 in relation to the structure of the aircraft bearing the frame 4. In addition, this extraction resulting in the progressive opening of the flap 1 pivoting around the hinge 6 also causes a relative rotation of the external end 18 of the piston in relation to the connecting brace 26, and this according to the pivot axis 24. As shown in FIG. 5, the flat surface 40 remains therefore in contact by gravity with the exterior surface of the cylinder 14, while the permanent magnet 66 slides relatively in relation to the interior rod 44 forming a track with which it remains in contact, and this according to the retraction direction 62.

Figure 6:
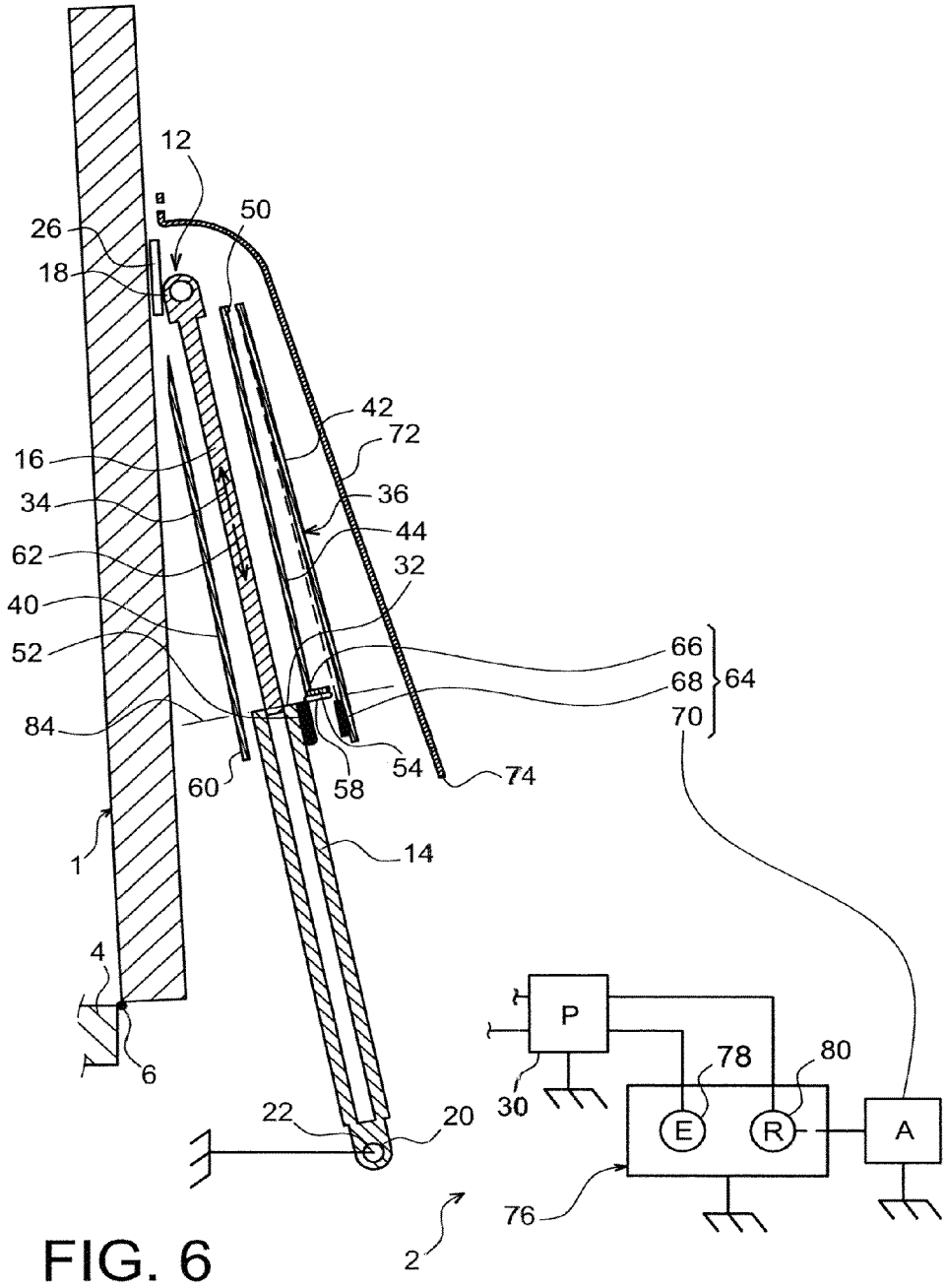

The principle mentioned hereinabove is encountered during the extraction of the piston 16 until the two stop surfaces belonging respectively to the first stop means 32 and to the second stop means 54, including here the lining 58, arrive in the same plane substantially orthogonal to the jack, schematised by the line 84 in FIG. 6. Beyond this instant, i.e. as soon as the piston occupies in relation to the cylinder an extracted position such as the second stop means 54 located beyond the first stop means 32 in the extraction position 34, there is an automatic displacement of the body 36 from the first angular position to a second angular position in relation to the jack 12, by magnetic attraction of the permanent element 66 and of the magnetic body 68 that is not powered electrically, and, in the preferred embodiment shown, also by gravity.

Figure 7:
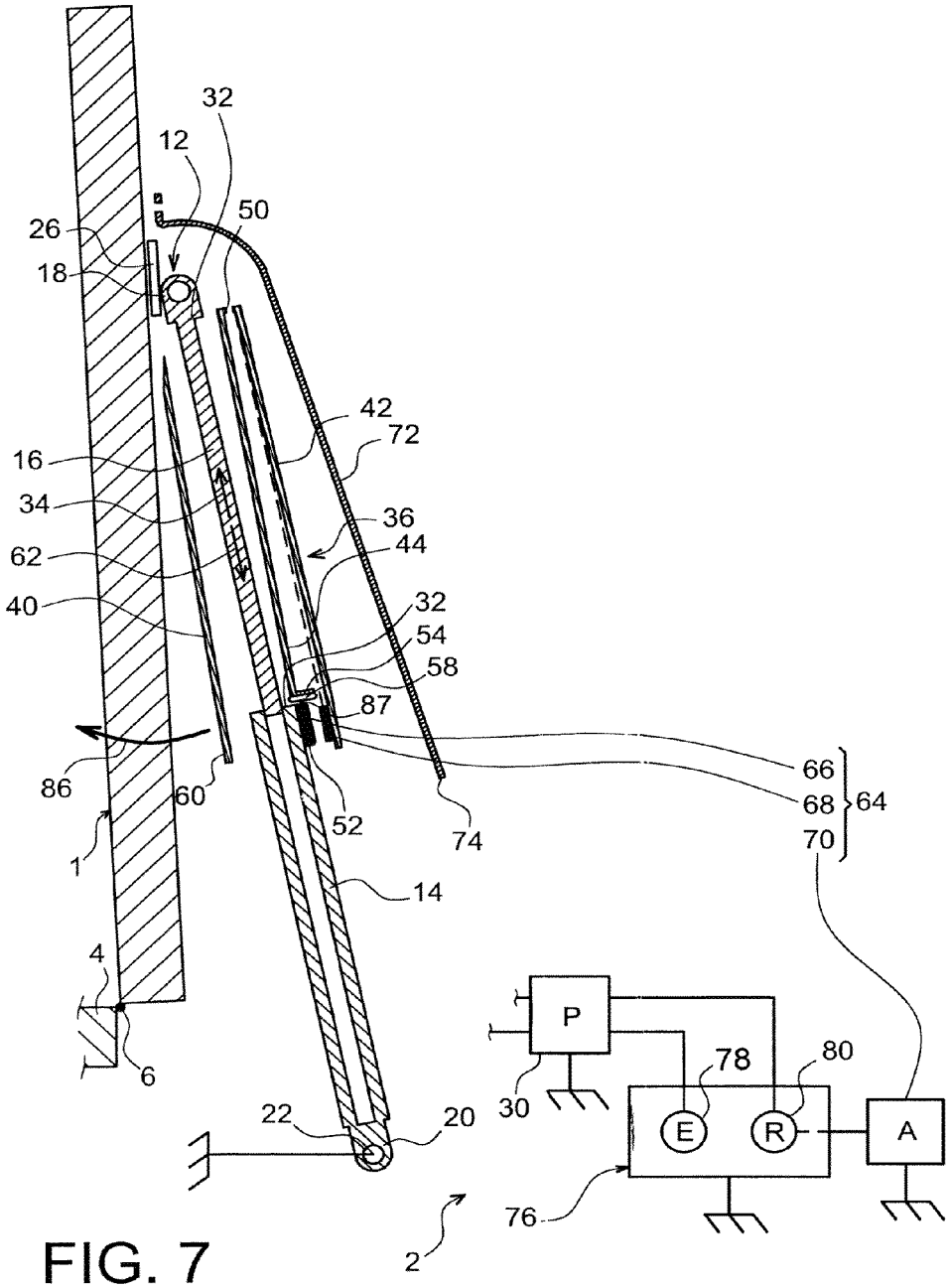
Figure 8:
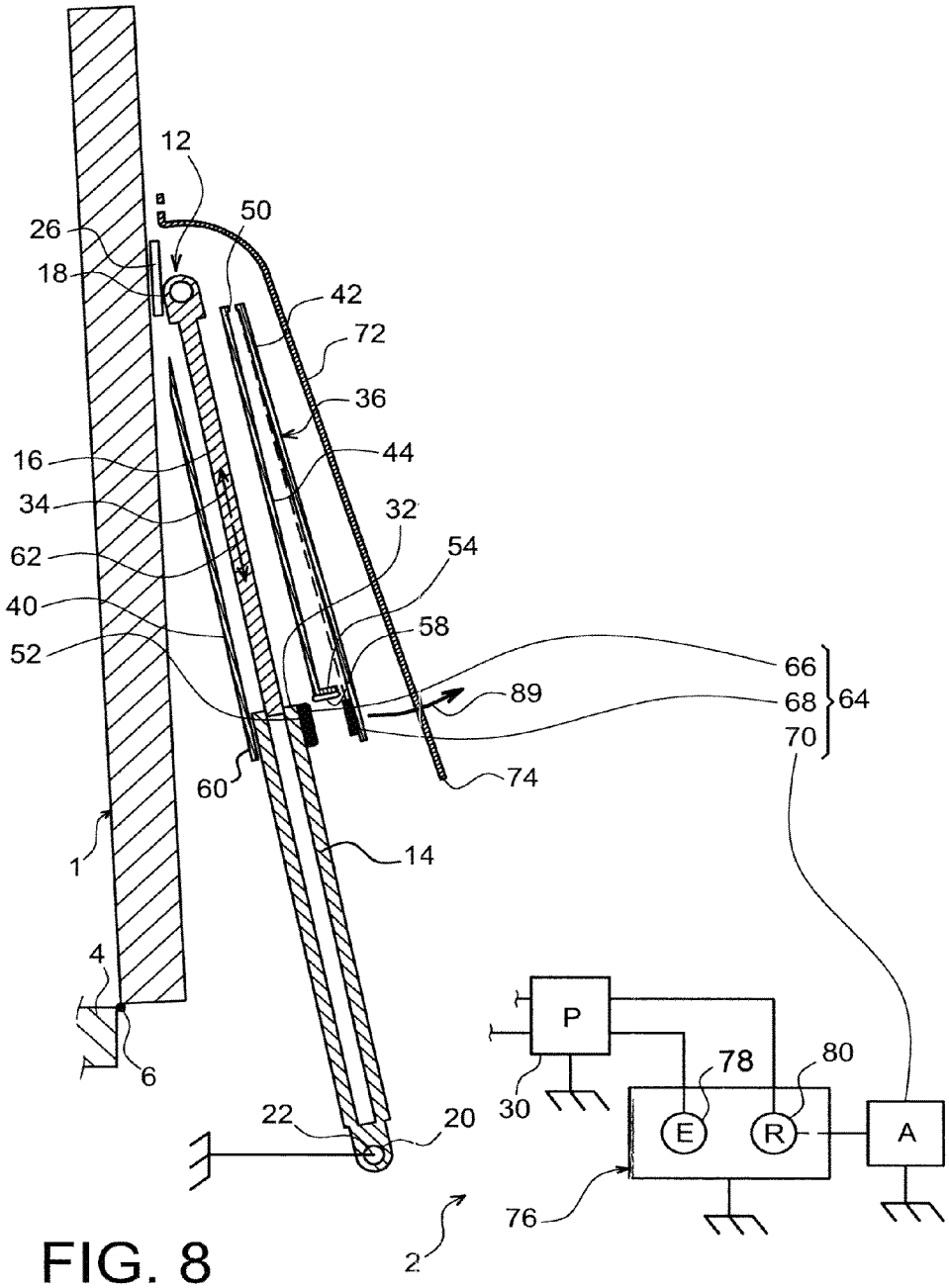

This magnetic attraction combined with the gravity causes a rotation of the body 36 around the pivot axis 24 in relation to piston 16, as schematised by the arrow 86 in FIG. 7.

The system 2 is therefore designed in such a way that the magnetic attraction is produced automatically, without operator intervention, as soon as the piston 16 is sufficiently extracted from the cylinder 14 in order to position its magnetic element 66 across from the magnetic element 68. In addition, the system 2 is also designed in such a way that the displacement by magnetic attraction of the body 36 to its second position or locking position is produced as soon as the second stop means 54 have extended beyond the first stop means 32 in the extraction position 34. As such, even if in the configuration shown the magnetic force begins to exert itself before the second means 54 have extended beyond the first means 32, the rotation of the body 36 around the pivot axis 24 is prevented by the stop of the magnet 66 against the hollow rod 44 forming a track, whereon it slides longitudinally.

So that the body 36 is maintained in its second position in a state such that its second stop means 54 are positioned across from the first stop means 32, but without contact with the latter, it is therefore arranged that the extraction of the piston 16 is stopped only after the body 36 has reached its second position. This ensures the presence of a space 87 between the first and second stop means 32, 54, when the piston 16 occupies its final desired extracted position shown in FIG. 7, also referred to as high position.

The spacing sought 87 according to the extraction position 34 between the stop surfaces of the first and second stop means 32, 54 is maintained as long as the flap 1 remains in its open position. As such, it is noted that in the event of a possible retraction of the piston 16 in the cylinder 14, likely to be encountered subsequent to an involuntary pressure exerted on the jack, for example by the walking of an occupant of the aircraft on this flap, the retraction shall thus be limited thanks to the rapid entry into contact of the first and second stop means arranged beforehand across therefrom. Therefore, the accidental closing of the flap 1 shall be advantageously directly stopped, which reduces to zero the risk of involuntary closing of the flap 1 in its frame 4.

When the operator wishes to close the flap 1, he then exerts pressure on the push-button switch 80 making it possible to successively generate two distinct operations. The first operation aims to control the power 70 of the device 64, so that electric pulses are delivered to the magnetic body 68, with the purpose of magnetising the latter. As such, the magnetised body 68 generates a magnetic field providing together with the magnetic field provided by the permanent magnet 66, an electromagnetic repulsion of elements 66, 68. This repulsion causes the body 36 to return to its first angular position relatively in relation to the jack 12, by pivoting around the pivot axis 24 as schematised by the arrow 89 in FIG. 8. This return to the first position facilitated by the absence of contact between the stop surfaces is thus carried out while the piston 16 is still occupying in relation to the cylinder 14 an extracted position such as the second stop means 54 are located beyond the first stop means 32, in the extraction position 34. One the repulsion has taken place and the putting into the first angular position or unlocking position of the body 36, information is sent to the pump 30 in order to provide the desired retraction of the piston 16, until the jack system 2 returns to its initial retracted configuration such as shown in FIG. 2.

The jack system 2 further comprises mechanical means of backup control 90, which can be seen in FIG. 3. This makes it globally possible to provide the displacement of the body 36 from the second angular position, to the first angular position. This entirely mechanical backup means 90 effectively makes it possible for an operator that is actuating them to fulfill the task that is normally the responsibility of the electromagnetic attraction/repulsion device, when the latter has broken down, in particular an electrical power breakdown of the magnetic body 68.

For example, the means 90 comprise a push-button switch 92 likely to be pressed by an operator according to a direction orthogonal to the plane of the flap. The end of push button 92 displaced according to this latter direction is provided to cause a control rod 94 to rotate according to its own axis 96, the control rod being arranged in parallel to the plane of the flap, and for example parallel to the aforementioned axes 22, 24. This control rod 94 bears a pressure roller likely to apply a force on the flat surface 40 of the body 36 during a rotation of the control rod 94 according to its own axis 96, this force thus generating in an entirely mechanical manner the desired pivoting of this same body 36 around the pivot axis 24. The pivoting generated, opposing the magnetic force between the elements 66, 68, allow the body 36 to return to its first angular position with regards to the jack 12 remaining fixed, a condition that must be satisfied for the retraction of the piston 16 in the cylinder 14.

Of course, diverse modifications can be made by those skilled in the art to the invention that has just been described, only by way of example and in a non-limited manner.

The invention claimed is:

1. A jack system including a jack provided with a cylinder wherein slides a piston having an external end, said cylinder being provided with a first stop means, the jack system comprising: a body arranged around said jack and hinged about said external end of the piston, according to a pivot axis, said body includes second stop means and being able to occupy, relatively in relation to the jack and according to the pivot axis, a first angular position authorizing an extraction/retraction of the piston in relation to the cylinder, as well as a second angular position uniquely allowed when the piston occupies in relation to the cylinder an extracted position such that said second stop means is located beyond said first stop means in an extraction position of the piston in relation to the cylinder, the body occupying said second position providing the facing, according to the extraction position, of the first and second stop means; and an electromagnetic attraction/repulsion device including a first element fixedly mounted on said cylinder as well as a second element fixedly mounted on said body, said device being designed to provide the displacement of the body from said first position to said second position, and inversely, by attraction/repulsion of said first and second elements.

2. The jack system set forth in claim 1, wherein said first and second elements of said electromagnetic attraction/repulsion device are respectively a permanent magnet and a magnetic body capable of being powered electrically by a power supply belong to said device, or inversely.

3. The jack system set forth in claim 2, wherein said device is designed to automatically provide the displacement of the body from said first position to said second position, by magnetic attraction of the first element and of the second element that is not powered electrically by said power supply.

4. The jack system set forth in claim 2 or claim 3, wherein said device is designed to provide the displacement of the body from said second position to said first position by electromagnetic repulsion of the first element and of the second element, the second element being powered electrically by said power supply in order to generate a magnetic field providing said repulsion.

5. The jack system as set forth in claim 2, further comprising a control module connected to said power supply of said electromagnetic attraction/repulsion device.

6. The jack system set forth in claim 5, wherein said control module includes at least one push-button switch.

7. The jack system as set forth in claim 1, wherein said first and second elements each take the form of an angular portion of a hollow cylinder.

8. The jack system as set forth in claim 1, wherein said second stop means is arranged at the free end of an interior hollow rod integral with said body.

9. The jack system set forth in claim 8, wherein when said body occupies said first angular position, said hollow rod is substantially parallel to said piston.

10. The jack system set forth in claim 8 or claim 9, wherein said hollow rod has another end connected fixedly on one portion of the end of the body hinged on said external end of the piston.

11. The jack system as set forth in claim 1, wherein said body forms a casing around said jack.

12. The jack system as set forth in claim 1, further comprising a connecting brace of the system, hinged around said external end of the piston, according to said pivot axis.

13. The jack system as set forth in claim 1, wherein said first and second elements of said electromagnetic attraction/repulsion device are respectively fixed exteriorly on an open end of the cylinder, and interiorly on an open end of the body.

14. The jack system as set forth in claim 1, wherein said first and/or second stop means are provided with a lining forming a friction surface.

15. The jack system as set forth in claim 1, further comprising mechanical means of backup control, making it possible to provide the displacement of the body from said second position to said first position, or inversely.

16. The jack system as set forth in claim 1, wherein said jack is pneumatic or hydraulic.

17. The jack system as set forth in claim 1, further comprising a pressurizing system of a fluid located in said cylinder of the jack.

18. A flap provided with an opening/closing system of the flap, wherein said opening/closing system is realized using a jack system as set forth in claim 1.

19. An aircraft comprising at least one flap as set forth in claim 18.

20. An aircraft comprising at least one jack system as set forth in claim 1.

* * * * *